United States Patent [19]

Madsen

[11] Patent Number: 4,899,884

[45] Date of Patent: Feb. 13, 1990

[54] SHIPPING AND SALES PACKING FOR STACKED WAFFLE CORNETS

[76] Inventor: Fritz V. F. Madsen, Grimhöjvej 7, DK-8220 Brabrand, Denmark

[21] Appl. No.: 241,192

[22] Filed: Sep. 7, 1988

[30] Foreign Application Priority Data

Sep. 7, 1987 [DK] Denmark ..... 4636/87

[51] Int. Cl.[4] ..... B65D 85/62; B65D 81/16; A21D 13/00

[52] U.S. Cl. ..... 206/499; 206/45.14; 206/486; 206/523; 206/587; 206/589; 211/49.1; 211/60.1; 211/133; 229/DIG. 7; 248/146; 426/124; 426/128; 426/139

[58] Field of Search ..... 206/45.14, 45.19, 485, 206/486, 490, 499, 515, 436, 516, 518, 521, 523, 587, 588, 589, 591, 593, 592, 526; 211/49.1, 60.1, 59.2, 126, 133, 2; 248/146; 426/124, 128, 138, 139; 229/DIG. 7

[56] References Cited

U.S. PATENT DOCUMENTS

| | | | |
|---|---|---|---|
| 1,176,932 | 3/1916 | Smith | 229/DIG. 7 |
| 1,713,961 | 5/1929 | Goodyear | 229/DIG. 7 |
| 2,142,567 | 1/1939 | Levy | 206/486 |
| 2,344,937 | 3/1944 | Brezier | 206/562 |
| 3,039,881 | 6/1962 | Shapiro | 206/562 X |
| 3,400,873 | 9/1968 | Bessett | 426/124 X |
| 3,406,856 | 10/1968 | Griffith et al. | 426/128 X |
| 3,835,994 | 9/1974 | Davis et al. | 206/499 |
| 4,269,316 | 5/1981 | Growney | 206/499 |
| 4,291,805 | 9/1981 | Seeley | 206/563 |
| 4,341,308 | 7/1982 | Pasquini | 206/485 X |
| 4,398,633 | 8/1983 | Weinstein | 206/499 |
| 4,454,949 | 6/1984 | Flum | 211/59.2 |

*Primary Examiner*—Bryon P. Gehman

*Attorney, Agent, or Firm*—Antonelli, Terry & Wands

[57] ABSTRACT

Cornet piles are placed in a support groove in a block member of a stiff lightweight material, with the block member having upstanding portions capable of supporting an overlying packing to thereby protect the cornet pile. The bottom of the block member is provided through holes, which serve as ventilation holes for cooling of the hot waffle cornets received from a baking machine and also as carrier holes for supporting cornets in uprights serving positions when the block member is turned upside-down into an inverted position in which it stands on the top ends of the formerly upstanding parts.

10 Claims, 2 Drawing Sheets

FIG.1
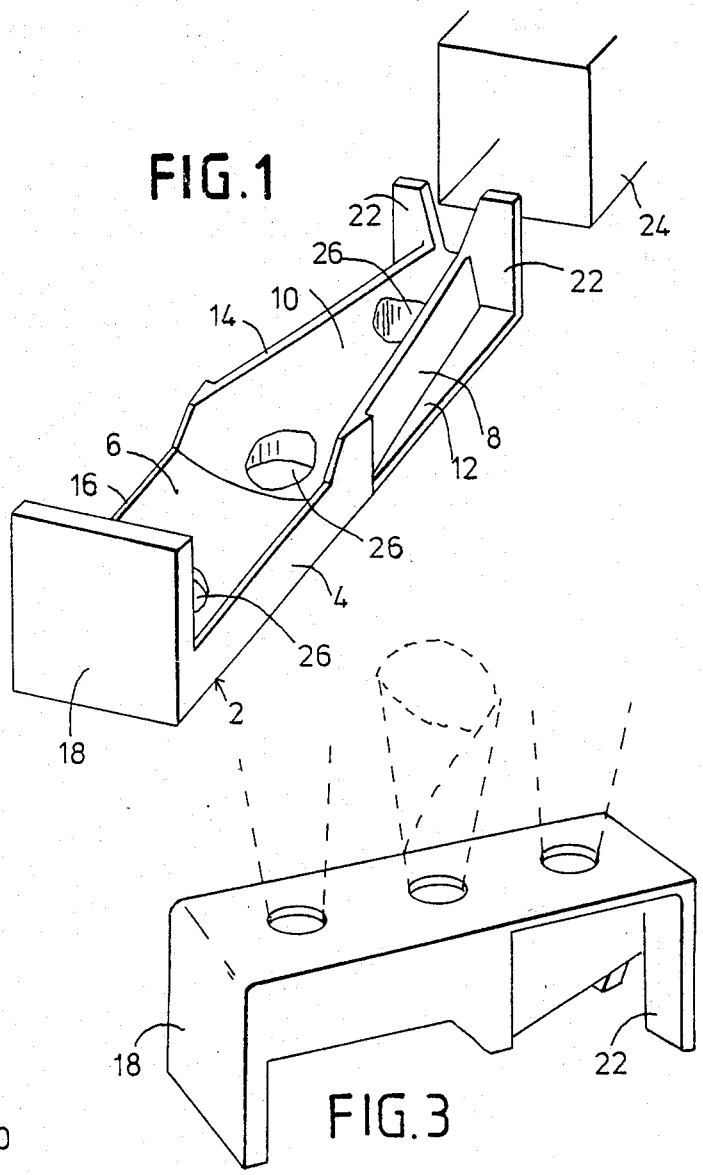
FIG.3
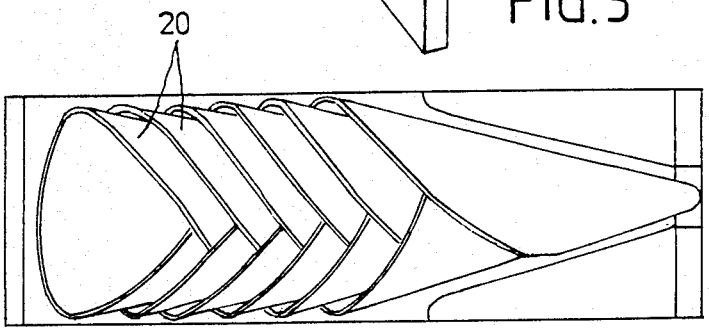
FIG.2

FIG.4
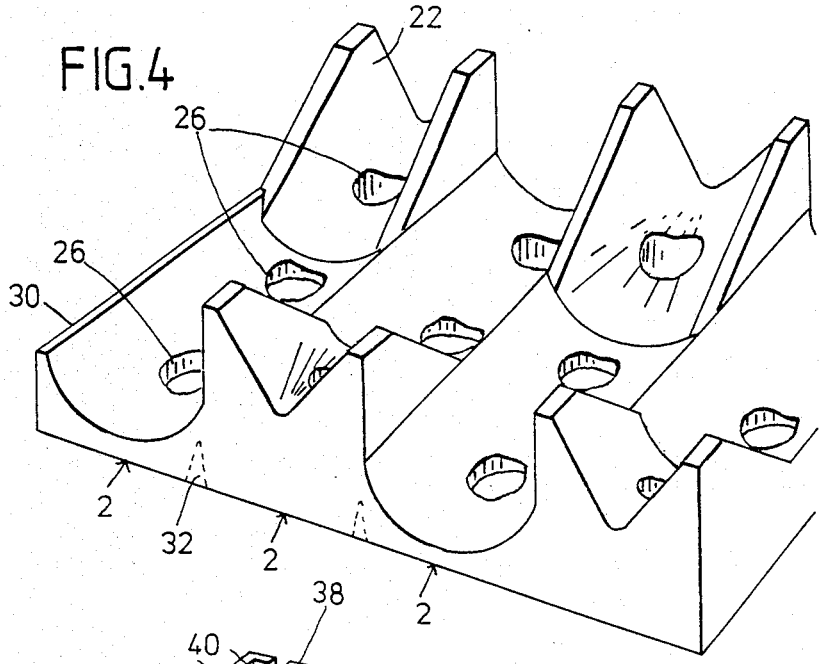
FIG.5
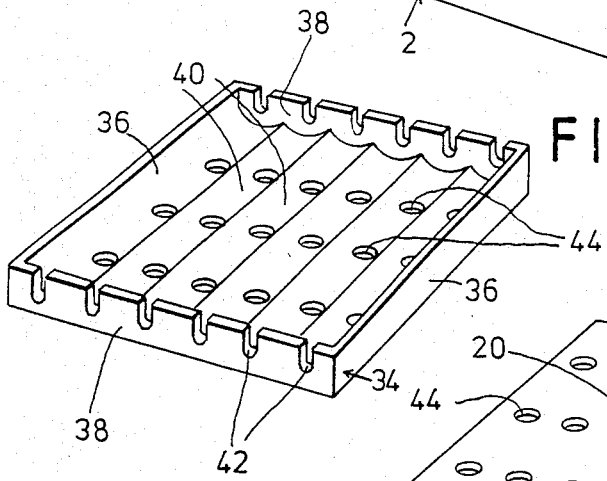
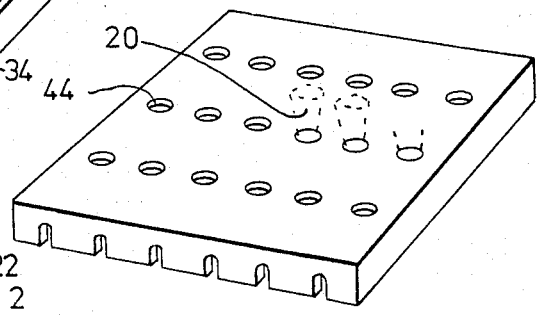
FIG.6
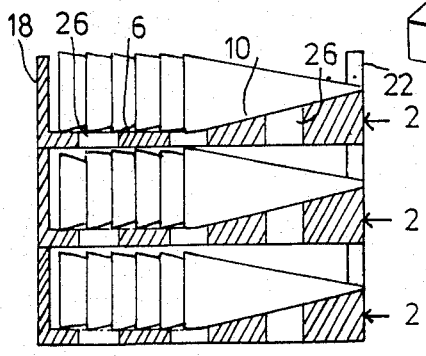
FIG.7

SHIPPING AND SALES PACKING FOR STACKED WAFFLE CORNETS

BACKGROUND OF THE INVENTION

The present invention relates to a shipping and sales box for conic waffles. It is customary that waffle members for cornets are piled and packed in rectangular cartons, which can be stacked together and transported to a receiving place, which can be a retail shop for ice-cream cones or shops where the cornet boxes are sold for home consumption of the cornets. Likewise, long-distance transport of whole container loads of the cornets to receiving places takes place, from where the cornets are distributed to the receivers. In connection with major consignments it is also known that the stacked cornets are placed on a plate formed base in several rows which are mutually separated by upright carton separators and on top of such a layer, yet another support plate can be placed to accommodate a further layer of cornets. Several such layers can then be packed in a correspondingly large carton box.

These kinds of packaging are none too efficient as it is well-known that for long transports and several reloadings a considerable waste must be accepted and, 20% is not unusual. It should be considered here that the cornets are relatively inexpensive items which do not warrant any considerable increase in cost of special packing as technically speaking it would present no problem to procure a more protective packing.

The invention takes into consideration that such packaging may be desirable if it can reduce the waste substantially as well as offering a relevant reusage value. It is realized with the invention that such a combination is achievable when using a supported packing which can protect the individual rows of cornets and which via its stiffness and spatial structure can be reused as support element for single cornets in their usual, vertical oriented position for use. It is well known that for preparing and handling out filled cornets, it can be difficult to handle the cornets unless use is made of a cornet holder shaped as a support plate having accommodating holes for the cornets, i.e. having an empty space underneath the holes for receiving the downwards projecting ends of the cornets. This requires a suspended position of the support plate, e.g. above a table top, i.e. an actual stand, and in connection with the invention it is recognized that such a stand could consist of a stiff, supporting and protecting packing for the cornets. More particularly, this packing is constructed such that a support plate part thereof is provided with the support holes for the cornets and when the same support plate part is connected to upwards projecting plate or leg parts which, without weighing down on the cornets, can accommodate the weight of one or several boxes on top and which, in and isolated condition, can be turned around to a position where the free ends of the actual plate or leg parts can be supported by a table top and thereby suspending the support plate at such a height above the table top that the pertinent cornets can be inserted into the support holes and can be accommodated in the support holes without reaching down to the table top.

An especially suitable embodiment of the invention comprises a support member shaped in such a manner that its top side is suitably rounded for supporting the lower portion of the circumference of the wide end parts of the cornets in the pertinent piled, lying row of cornets, while at one end it has a semiconical part for supporting the outermost exposed cornet in the pile or row of cornets. This particular support and associated side support of the base cornet of the pile has proved quite essential for achieving a reduced percentage of waste, as a free movement or rolling ability of the outer end of the base cornet in both vertical and horizontal directions otherwise contribute to the damages that occur during handling and transport of the cornet boxes. This significant advantage can be achieved even though the actual support area be perforated by one or more of the support holes for the cornets as such local perforations will not be crucial for the required stability of the cornet support.

Thus, one important aspect of the invention is the provision of a special carrier member for the cornets, and because such members should be pilable, with or without a surrounding carton, they will be attractive for use in direct connection with the production of the cornets where they may act as recipients for the warm cornets delivered from the cornet baking machines, such that it will be unnecessary to arrange for a later transfer of the cornets from the traditional recipients to the carrier members. However, with the use of such carrier members as recipients the serious problem would occur that the warm cornets are isolated from the convection air which is otherwise produced by the cornets when rested on a more open receiving surface, and it will be appreciated that the discussed holes in the carrier members according to the invention will show the important advantage of allowing convection or cooling air to penetrate the carrier member. For securing a desired maximum crispness of the cornets it is important that they are air cooled relatively quickly after leaving the baking machine.

It will be appreciated, therefore that the discussed holes may serve two entirely different purposes.

BRIEF DESCRIPTION OF THE DRAWINGS

The invention, which is defined in more detail in the claims, is explained more detailed in the following description with reference to the drawing in which:

FIG. 1 is a perspective view of a packing according to the invention;

FIG. 2 is a top view thereof when filled with cornets;

FIG. 3 is a perspective view of the packing utilized as a stand for upright cornets;

FIG. 4 is a perspective view of another design for a packing according to the invention;

FIGS. 5 and 6 are perspective views of a third design shown in a carrying and a holding position, respectively; and FIG. 7 is a sectional view illustrating the piling of carrier block members in the production phase of the waffle cornets.

DETAILED DESCRIPTION

The packing or tray shown in FIG. 1 includes a packing or carrier member generally designated by the reference numeral 2 of expanded polystyrene. The packing or carrier member 2 has a rectangular base, the left half of which has a structure 4, the top side 6 of which is slightly smaller than semicylindrical while above the right half a corresponding structure 8 is situated the upper downwards arched surface 10 which forms a conical pointed extension of the top side 6, whereby the structure 8 in itself is conically pointed towards the right such that outer triangularly shaped base parts 12 are left at the bottom. The upper edge of the structure 8 extends essentially along the median plane of an associated cornet 20 placed on the conical surface 10, i.e. each cross section of the surface 10 covers approx. 180° while the upper edge 16 of the structure 4 is situated at a lower level, i.e. such that the cylindrical surface 6 covering less than 180°. The width of the member 2 is adapted to the top diameter of the cornets 20 to be exactly supported by which the carrier member 2 therefore, it is desirable that the upper edge 16, which in the relevant material should not be knife-edged, has a certain width and is placed a little under the median plane of the cornets 20.

At its left end the carrier member 2 is shaped with an upwards protruding end wall 18 which protrudes up to a level immediately above the upper edge area of relevant cornets 20 placed in the carrier member 2, (FIG. 2). Also at the opposite end protruding wall 22 are provided, protruding to the same level as the upper edge of the and wall 18. As indicated in dot-dash lines these walls 22 could consist of an end wall having a V-shaped incision for accommodating the tip of the outermost cornet tip, i.e. corresponding to the simple end wall 18, but for the reason stated below it is preferred to shape the walls 22 in the manner shown, i.e. extending along the walls of the structure 8 without reaching quite out to the side edge of the base of the carrier member 2.

When a pile of cornets has been placed in the packing member 2 and inserted in an outer carton 24 shown in FIG. 1, which outer carton 24 is preferably encased in a moisture proof transparent cover (not shown) of a suitable sheet material, and the entire package is suitable as retail sales packing of the cornets, e.g. for six cornets. During storage and transport, the cartons 24 will, of course, be stacked and the cornets will be protected by the carrier members 2 also filling the cartons in the height direction, as the upright end walls 18 and 22 reach the ceiling of the cartons 24 and thereby constitute firm supports for the bottom side of the carrier member 2 in a carton above. The structure 4 will ensure that the cornets in the carton will not be squashed in the lateral direction.

In practice the placing of the cornets 20 in the carrier members 2 will take place at a cornet factory while the cornets 20 are still hot from baking and it is essential for the required crispness of the cornets 20 that they are cooled before being inserted into the cartons 24. It is therefore natural that a stacking together of the carrier members 2 filled with cornets 20 be effected successively as they leave their position or positions for receiving piles of freshly baked, hot cornets 20 and that the filled carrier members 2 are successively destacked for insertion into respective cartons 24 upon the cornets 20 being sufficiently cooled. It is essential that the remaining moisture in the cornets 20 can escape during cooling and this is exactly why it is preferred to let the upright walls 22 be placed such that they do not take up the complete width of the carrier member 2. When the carrier member 2 is placed adjacent to corresponding carrier members 2, an end opening between each pair of packing members 2 will appear through which the residual moisture from the cornets 20 can escape. For the same reason the end wall 18 might be shaped with upwards converging side edges but it is desirable that the carrier members 2 at least at one end take up the entire carton 24 in both the height and the transverse directions.

As illustrated in FIG. 1 a number of wide holes 26 are provided in the bottom of the carrier member 2. These holes likewise serve the purpose of conducting moisture away from temporarily piled or adjoining cornet-filled carrier members 2, as these holes will permit a certain upward convection of air.

The holes 26 are, however, dimensioned according to a completely different criterion, and as shown in FIG. 3, the holes 26 are suitable for accommodation holes for the individual cornets 20 when the packing or carrier member 2, after removal of the cornets 20, is turned upside-down and placed on a table, now being supported by the upper edges of the upright endwalls 18 and 22. Here it is vital that the diameter of the holes 26 has been selected such that the cornets 20 relative the actual carrier member 2 can be carried in a vertical position without the cornets reaching the supporting table top or at least without tending to reach significantly below this. Each hole has a diameter smaller than a diameter of a larger conical section of a cornet to be received in the stack therein, but larger than a diameter of a smaller conical section of the cornet. When the holes 26 are adapted in this manner it is achieved both that the holes 26 offer an advantageous ventilation effect prior to the packing of the piles of cornets 20 and that the packing or carrier members 2 partly offer a waste-reducing protection of the cornets 20 during their storing and shipping and partly are reusable as serving stands for the single cornets 20, which greatly facilitates the procedure required in filling and serving cones.

FIG. 4 illustrates a packing tray 30 intended for accommodation of several, parallel, piled rows of cornets 20 and the packing tray 30 consisting of a row of coherent carrier members 2 forming packing units. The packing units are parallel, but alternately oppositely oriented, such that the upright parts 22 are found alternatingly at one or the other end of the tray. End walls 18 like in FIGS. 1–3 do not exist i.e. there is completely open space between the upright parts 22 of the individual carrier members 2 forming the packing units along each end edge of the packing tray 30. This considers precisely the possibility of a demoisturing of the cornets 20 when packing trays 30 with hot cornets 20 are being stacked. The packing trays 30 are preferably quadratic such that they can be stacked with a mutual rotation of 90° rendering a good stability to the pile. The packing trays 30 are intended for delivery to the trade and a choice can be made to pack e.g. three or four piled packing trays 30 in a large carton (not shown) having a moisture proof cover. The cornets will be exceedingly effectively supported in the packing trays 30 and the carton, and it will be appreciated that every single packing tray 30 can be utilized as a serving tray when turned upside-down as the carrier members 2 forming the packing units are provided with holes 26 as in FIG. 1. Due to the alternating opposite positions of the upright parts 22, the presence of end walls 18 as in FIGS. 1–3 is not required.

The base part of the packing tray 30 can be embodied with lower V-shaped grooves along the joints between the carrier members 2 of the packing unit of the packing tray 30 whereby separation of the carrier units 2 from the packing tray 30 can easily be performed by a mere breaking off from the latter. Due to the absence of end walls 18 (FIG. 1) the separated individual carrier members 2 will not be immediately applicable as serving stands, but can be used for this purpose all the same provided it is actually ensured that the free end of each carrier member 2 is otherwise being supported e.g. by using a fixed, and designed for the purpose, carrying bracket on a serving counter or for temporary support of the free end of the separated individual carrier members 2.

However, it would of course be possible to design the packing tray 30 comprising upright end walls 18 at the free end of each of the carrier members 2.

On the other hand it is especially advantageous that such end walls 18 are in fact absent as it facilitates placing the stacked cornets 20 by an insertion movement onto the carrying surfaces of the carrier members 2 whereby the cornets 20 are easily inserted on the packing tray 30 from an automatic baking machine already having assembling means for making small piles of cornets 20.

Moreover it will be appreciated that the carrier members 2 easily can comprise mutually separated supporting legs at their free ends, all the same allowing an unobstructed insertion of a cornet pile provided the distance between the supports suffices the allowance of this insertion such that each carrier members 2 can be individually supportable as serving stand in upside-down position; however, this only requires a sufficient mutual distance of the supporting legs, in turn meaning a slightly increased width of the individual carrier members 2. Using such legs will not necessarily require the upright walls 22 to be alternately oppositely oriented as such legs will ensure the necessary stacking support at the stacking of the packing trays 30 and the necessary support of the packing tray 30 or the single carrier members 2 as serving stands by utilizing the holes 26. If or when the upstanding walls 22 for each member 2 can thus be placed along one and the same end edge of the packing tray 30, the further advantage can be achieved that the cornet piles can increase usability of the packing tray 30 which can then be filled without having to be turned between each receiving operation.

In FIG. 5 is illustrated a tray which is an ordinary box-shaped tray member generally designated by the reference numeral 34 with upright side edges 36 and end edge 38 while the base of the box-shaped tray is divided into part-cylindrical sections 40 each for receiving a horizontal pile of cornets 20.

In the end walls 38 incisions 42 are made, constituting openings for vapor to escape from the cornet piles placed when still hot. At the bottom of the tray member 34 rows of holes 44 are provided which, as shown in FIG. 6, in an upside-down position of the tray 34, will be ideal support holes for upright cornets 20.

It also applies here that a number of trays 34 can be stacked and placed in a common shipping carton (not shown).

The invention comprises the possibility that also the aforemention shipping cartons, including those pertaining to FIGS. 1–3 can be provided with holes preferably with depressable circular blank portions such that the cartons, too, can be utilized as serving stands for the cornets 20.

As mentioned, the carrier members 2, packing tray 30, and tray 34 are well suited to receive the cornet piles from a waffle baking and cornet shaping machine, which may deliver the cornet piles to the carrier members 2 or trays 30, 34 either by laying down the piles into the grooves of the carrier members 2 or trays 30, 34 or by pushing the piles lengthwise into the grooves. An associated problem is that the carrier members 2 or trays 30, 34 as consisting of a lightweight material will normally be pronounced heat insulating, and that it is desirable to obtain a rapid cooling of the newly baked waffle cornets as assembled in superimposed piles rested in piled carrier members 2 as illustrated in FIG. 7. It will be appreciated that due to the holes 26 there may be a flow of cooling convection air up through the respective piles of cornets 20.

I claim:

1. A shipping and sales packing for laterally stacked conical waffle cornets, the packing comprising at least a block member of light-weight material, at least one carrying and supporting groove means for carrying and supporting wide end parts of the laterally stacked cornets when received therein, a conical groove means for accommodating an outer exposed cornet in the laterally stacked cornets when received therein, at least one upright portion provided at least at one end of the block member and protruding to a level immediately above a top level of the laterally stacked cornets when supported by the block member, a plurality of through-hole means provided at base of the block member for a cooling ventilation of the cornets when placed in the carrying and supporting groove means of the block member in a newly-baked warm condition, and wherein each said hole means has a diameter smaller than a diameter of a larger conical section of an individual one of the stacked cornets but larger than a diameter of a smaller conical section of the individual cornets whereby each said hole means is adapted to carry or support a vertically oriented cornet therein when the block member is placed in an inverted carrying position supported by said at least one upright portion.

2. A packing according to claim 1, wherein the at least one upright portion is arranged at an end of the block member for accommodating a tip of the stacked cornets at a distance to side limits of the block member.

3. A packing according to one of claim 1 or 2, wherein the at least one upright portion is arranged at an end of the block member for accommodating a wide end of the stacked cornets and is fashioned as an upright end wall part.

4. A packing according to one of claims 1 or 2, wherein the at least one upright portion is arranged at an end of the block member for accommodating a tip of the stacked cornets and is provided with an incision extending to a tip carrying area of the block member.

5. A packing according to claim 1, wherein a plurality of said carrying and supporting groove means are disposed in parallel in a wide block member for respectively accommodating a plurality of stacked cornets.

6. A packing according to claim 5, wherein said at least one upright portion is alternately arranged at opposite ends of the respective parallel groove means.

7. A packing according to claim 6, wherein the at least one upright portion is arranged at a cornet tip accommodating end of the carrying and supporting groove means, and opposite ends of said carrying and supporting groove means are opened to facilitate an immediate insertion of the stacked cornets on or into the respective carrying and supporting groove means.

8. A packing according to claim 5, wherein the block member has a quadratic base.

9. A packing according to claim 5, wherein the block member is fashioned as a tray member having upright side edges of which transverse edges thereof relative to the carrying and supporting groove means includes V-shaped incisions.

10. A packing according to one of claims 1, 2, 5, 6, 7, 8, or 9, wherein the lightweight material is an expanded polystyrene.

* * * * *